US012196052B2

(12) United States Patent
Costa de Oliveira et al.

(10) Patent No.: US 12,196,052 B2
(45) Date of Patent: Jan. 14, 2025

(54) CEMENTING HEAD

(71) Applicant: Saudi Arabian Oil Company, Dhahran (SA)

(72) Inventors: Victor Carlos Costa de Oliveira, Dhahran (SA); Daniel Thomas Scott, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 71 days.

(21) Appl. No.: 17/979,570

(22) Filed: Nov. 2, 2022

(65) Prior Publication Data

US 2024/0141744 A1 May 2, 2024

(51) Int. Cl.
*E21B 33/05* (2006.01)
*E21B 33/13* (2006.01)

(52) U.S. Cl.
CPC ..... *E21B 33/05* (2013.01); *E21B 33/13* (2013.01)

(58) Field of Classification Search
CPC ..... E21B 33/05; E21B 33/13; E21B 33/134; E21B 33/138; E21B 33/146; E21B 33/14; E21B 33/16; E21B 33/165; E21B 33/167
See application file for complete search history.

(56) References Cited

U.S. PATENT DOCUMENTS 1,882,099 A 10/1932 Trouth
5,205,359 A * 4/1993 Stephenson ..... E21B 43/261 221/9
6,182,752 B1 * 2/2001 Smith, Jr. ..... E21B 33/05 166/70
8,770,293 B2 7/2014 Giem et al.
2010/0294511 A1 * 11/2010 Winzer ..... E21B 33/068 166/69
2014/0352968 A1 * 12/2014 Pitcher ..... E21B 43/2607 166/308.1
2019/0186228 A1 * 6/2019 Beckett ..... E21B 33/16
2024/0175350 A1 5/2024 Rivas Martinez et al.

OTHER PUBLICATIONS

Lavaure et al., "A Safer Approach to Controlling the Cementing Operations at the Wellhead," SPE 23261, presented at the First International Conference on Health, Safety, and Environment, The Hague, The Netherlands, Nov. 1991, 12 pages.

* cited by examiner

*Primary Examiner* — Caroline N Butcher
(74) *Attorney, Agent, or Firm* — Fish & Richardson P.C.

(57) ABSTRACT

A wellbore assembly includes a pipe body and a chamber. The pipe body resides at a terranean surface of a wellbore and is fluidly coupled to a surface inlet of the wellbore. The chamber is coupled to the pipe body and has multiple slots each configured to house a wellbore component. Each slot revolves about a central axis of the chamber to align its respective wellbore component with a bore of the pipe body. The pipe body has a fluid inlet fluidly coupled to a pump that flows fluid to the pipe body. The fluid inlet is disposed upstream of the chamber. The pipe body directs the fluid from the fluid inlet to the inlet of the wellbore to push, from a first slot, a first wellbore component that is to be deployed downhole within the wellbore.

20 Claims, 4 Drawing Sheets

CEMENTING HEAD

FIELD OF THE DISCLOSURE

This disclosure relates to wellbore equipment, and more particularly to wellhead equipment for performing cementing operations.

BACKGROUND OF THE DISCLOSURE

A cementing head is an assembly of equipment at the surface of a wellbore. The wellhead is in fluid communication with the wellbore to flow cement, fluids, and equipment into the wellbore to complete or fix the wellbore. Cementing operations include deploying cementing plugs from the cementing head to a downhole location of the wellbore. Methods and equipment for improving cementing operations are sought.

SUMMARY

Implementations of the present disclosure include a wellbore assembly that includes a pipe body and a chamber. The pipe body resides at a terranean surface of a wellbore and is fluidly coupled to a surface inlet of the wellbore. The chamber is coupled to the pipe body and has multiple slots each configured to house a wellbore component. Each slot revolves about a central axis of the chamber to align its respective wellbore component with a bore of the pipe body. The pipe body has a fluid inlet fluidly coupled to a pump that flows fluid to the pipe body. The fluid inlet is disposed upstream of the chamber. The pipe body directs the fluid from the fluid inlet to the inlet of the wellbore to push, from a first slot, a first wellbore component that is to be deployed downhole within the wellbore.

In some implementations, the pipe body is fluidly coupled to the wellbore casing. The first wellbore component has a first cementing plug and the fluid includes cement slurry. The chamber has a second slot housing a second cement plug that has a solid core. The second slot revolves, after deploying the first cementing plug, about the central axis of the chamber to align the second cement plug with the bore of the pipe body. The pipe body directs displacement fluid downhole to push and deploys, with the displacement fluid, the second cementing plug to a downhole location of the casing.

In some implementations, the first cementing plug has a hollow core and a rupture disk or diaphragm disposed at the hollow core. The pump pressurizes the cement slurry sufficiently to rupture, with the first cementing plug at a downhole end of the casing, the disk or diaphragm to flow the cement through the hollow core and out the casing into an annulus defined between the casing and the wellbore.

In some implementations, the pipe body directs the displacement fluid downhole to push the second cementing plug at sufficient pressure to rupture the disk or diaphragm and continue to push the second cementing plug to land at the first cementing plug.

In some implementations, the wellbore assembly has a drive coupled to the plurality of slots and configured to move and revolve the slots about the central axis of the chamber.

In some implementations, the wellbore assembly has a controller coupled to the drive. Each slot includes a sensor. The controller is communicatively coupled to each sensor and configured to determine, based on information received from a respective sensor, whether a respective slot at the bore is properly aligned with the bore. The controller sends instructions to the drive to rotate, based on the determination, the slots to align the respective slot with the bore.

In some implementations, the wellbore assembly has at least one of a flow meter sensor communicatively coupled to the controller, a timer communicatively coupled to the controller, a battery communicatively coupled to the controller, or a data storage device communicatively coupled to the controller. The controller controls at least one of the pump and the drive based on information received from at least one of the flow meter, the timer, or the data storage device.

In some implementations, the controller determines, based on information received from at least one of the flow meter, the timer, or the data storage device, component information including at least one of a depth or location of each deployed wellbore component within the wellbore and a size or type of each wellbore component. The controller to transmits, to a receiver, the component information.

In some implementations, the controller is wirelessly coupled to an input device configured to transmit, to the controller, input instructions to control the wellbore assembly.

In some implementations, the wellbore assembly includes a manifold assembly coupled to the pipe body. The manifold assembly includes a first pipe configured to be fluidly coupled to the pipe body at the fluid inlet and a second pipe configured to be fluidly coupled to the pipe body at a second fluid inlet of the pipe body. The chamber is disposed between the first fluid inlet and the second fluid inlet, and each of the first and second pipes flow fluid into the pipe body during a cementing operation.

Implementations of the present disclosure include a method that includes flowing a fluid into a wellbore assembly. The wellbore assembly has (i) a pipe body disposed at a terranean surface of a wellbore and fluidly coupled to an inlet of the wellbore, and (ii) a chamber coupled to the pipe body. The chamber has a plurality of slots each configured to house a wellbore component. Each slot revolves about a central axis of the chamber and with respect to the pipe body to align one slot at a time with a bore of the pipe body. The method also includes flowing the fluid from an inlet of the pipe body upstream of the chamber to the wellbore, pushing a first wellbore component out of its aligned slot and downhole into the wellbore. The method also includes flowing the fluid downhole within the wellbore to deploy the first wellbore component to a downhole location of the wellbore.

In some implementations, the pipe body is fluidly coupled to a wellbore casing. The first wellbore component includes a first cementing plug and the fluid includes cement slurry. The chamber has a second slot housing a second cement plug including a solid core. The second slot revolves, after deploying the first cementing plug, about the central axis of the chamber to align the second cement plug with the bore of the pipe body. The method further includes flowing a displacement fluid downhole from the pipe body, deploying the second cementing plug to a downhole location of the casing and pushing the cement slurry downhole with the second cement plug.

In some implementations, the first cementing plug has a hollow core and a rupture disk or diaphragm, and flowing the cement slurry includes flowing the cement slurry at a pressure sufficient to rupture, with the first cementing plug at a downhole end of the casing, the disk or diaphragm to flow the cement through the hollow core and out the casing into an annulus defined between the casing and the wellbore.

In some implementations, the wellbore assembly includes a drive coupled to the plurality of slots. The drive is coupled to a controller that controls the drive to revolve the slots about the central axis of the chamber until a respective slot is aligned with the bore of the pipe body. Flowing the fluid to push the first wellbore component includes flowing the fluid after the respective wellbore component is aligned with the bore of the pipe body.

In some implementations, the wellbore assembly has at least one of a flow meter sensor communicatively coupled to the controller, a timer communicatively coupled to the controller, a battery communicatively coupled to the controller, or a data storage device communicatively coupled to the controller. The controller controls the pump, and flowing the fluid to push the first wellbore component includes activating, by the controller, the pump to flow the fluid based on information received by the controller from at least one of the flow meter, the timer, or the data storage device.

DETAILED DESCRIPTION OF THE DISCLOSURE

The present disclosure relates to methods and equipment for cementing a wellbore, and specifically for cementing a casing within a wellbore by using cementing plugs.

Particular implementations of the subject matter described in this specification can be implemented so as to realize one or more of the following advantages. For example, the cementing assembly of the present disclosure allows different cementing plugs to be used automatically and without opening the pipe body, which can save time and resources. Additionally, the chamber with multiple cementing plugs allows the continuous deployment of cementing plugs, which can improve efficiency and reduce the risk associated to human intervention.

Figure 1:
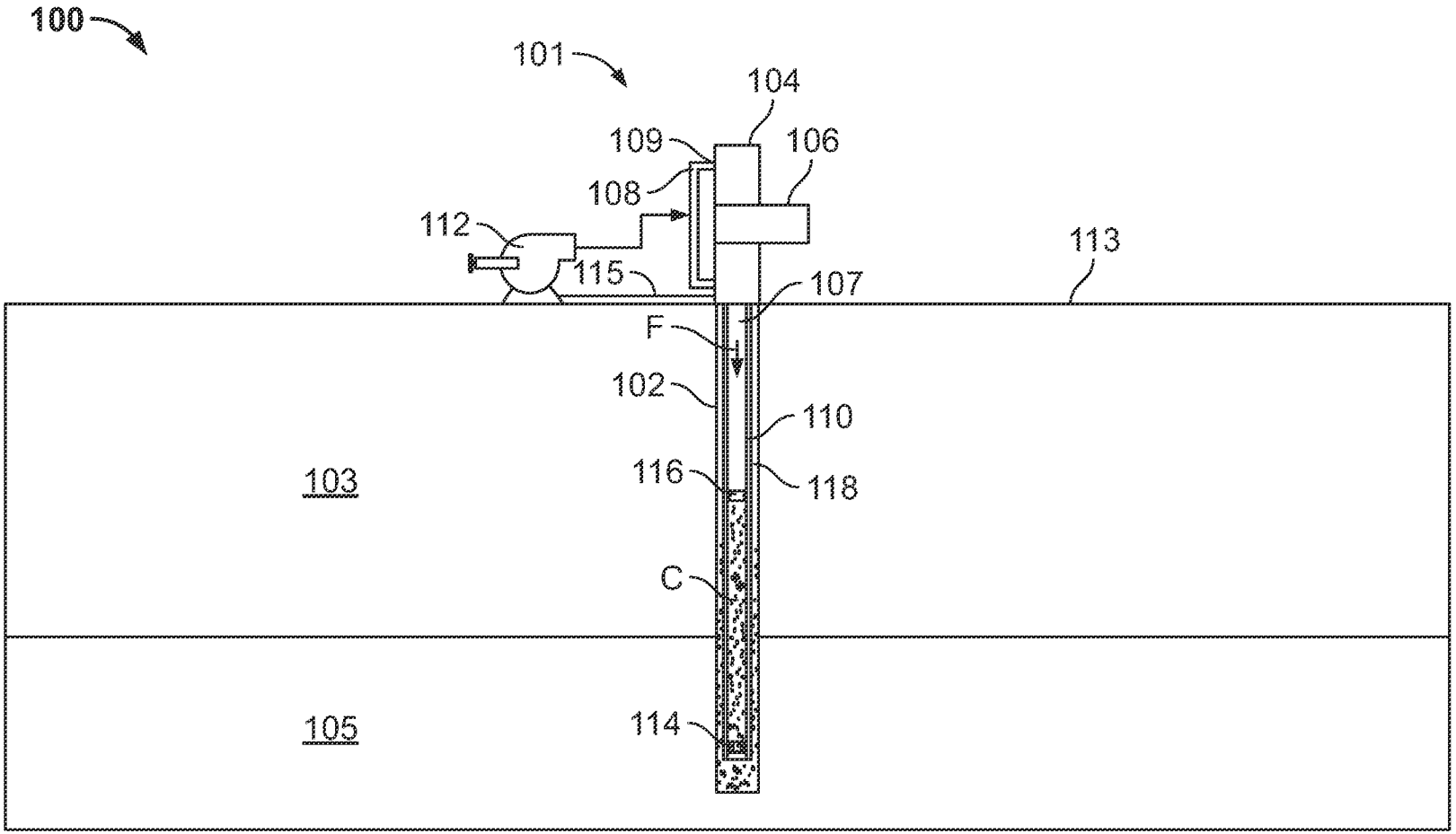
FIG. 1 is a front schematic view, partially cross-sectional, of a wellbore assembly for cementing a wellbore.

FIG. 1 shows a wellbore assembly 100 that includes a wellbore 102 and a cementing assembly 101 fluidly coupled to the wellbore 102. The wellbore 102 can be a horizontal or non-vertical wellbore that extends from a terranean surface 113 of the wellbore to a geologic formation 103. The geologic formation can include a hydrocarbon reservoir 105 from which hydrocarbons can be extracted.

The cementing assembly 101 includes a pipe body 104 (e.g., an assembly of multiple pipes) that resides at or near the terranean surface 113 of the wellbore 102. The pipe body is fluidly coupled to a surface inlet 102 of the wellbore. The cementing assembly 101 also includes a chamber 106 that is coupled to the pipe body 104.

As further described in detail below with respect to FIG. 2, the chamber 106 has multiple slots each configured to house a wellbore component 114, 116 (e.g., cementing plugs, darts, and other deployable equipment). The wellbore components 114, 116 can be deployed during wellbore operations. For example, during a cementing operation, a first cementing plug 114 and a second cementing plug 116 can be deployed from the chamber 106 to cement a casing 110 within the wellbore 102.

The slots of the chamber revolve about a central axis of the chamber to align with a bore of the pipe body 104. The pipe body 104 has a fluid inlet 109 upstream of the chamber 106. The fluid inlet 109 can be part of a manifold assembly 108 that is coupled to the pipe body 104. The pipe body 104 is fluidly coupled to one or more pumps 112 that flow fluid (e.g., cement "C" and displacement fluid "F", with one or more pumps flowing cement and the same or different one or more pumps flowing displacement fluid) into the pipe body 104 and into the wellbore 102. The pump 112 can be communicatively coupled to the cementing assembly 101 wirelessly or through a cable 115 to receive instructions from a controller of the cementing assembly 101. The pipe body 104 directs the fluid from the fluid inlet 109 to the inlet of the wellbore 107 to push, from a slot of the chamber 106, a respective wellbore component that is to be deployed downhole within the wellbore 102.

For example, to cement the wellbore 102, the pump 112 first flows cement slurry "C" to the inlet 109 of the pipe body 104 to push a first cementing plug 114 out of the chamber 106 and into the wellbore 102. Then, after the slots in the chamber 106 rotate to align the second cementing plug 116 with the pipe body 104, the pump 112 flows a displacement fluid "F" (e.g., mud) to push the second cementing plug 116 out of the chamber 106. The pump 112 pressurizes the cement "C" flowing the displacement fluid "F" until the cement breaks or ruptures the first cementing plug 114 to flow into an annulus 118 defined between the casing 110 and a wall of the wellbore 102. The pump 112 continues to pump displacement fluid until the second cementing plug 116 reaches the first cementing plug 114 at the downhole end of the casing 110.

Figure 2:
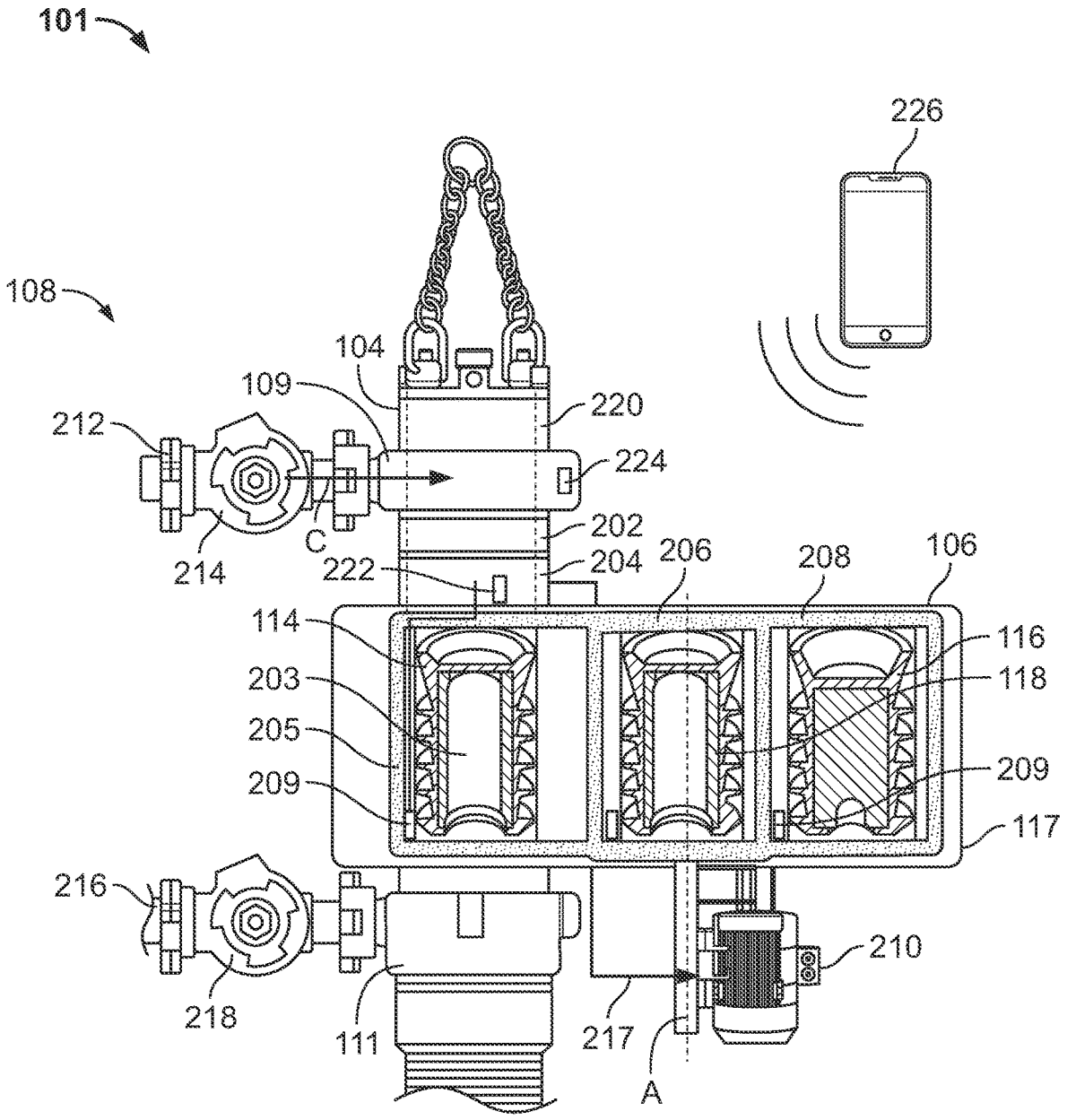
FIG. 2 is a schematic front view, partially cross-sectional, of a cementing assembly.

Referring now to FIG. 2, the chamber 106 has multiple slots 205, 206, 208 that house cementing plugs 114, 118, 116 respectively. The chamber 106 can include two, three, or more slots. The chamber 106 can have a housing 117 that can be fixed to the pipe body 104, with the slots 205, 206, 208 rotatable with respect to the housing 117. Specifically, the slots revolve about a central axis "A" of the chamber 106 to align its respective cement plug with the bore 220 of the pipe body 104, similar to a revolver cylinder revolving to align each bullet with the barrel of the revolver. Once the respective slot is aligned with the bore 220, the slot can form a fluid seal with the bore to prevent fluid from flowing into the other slots or outside of the chamber 106. In some implementations, the housing 117 is rotatable and the slots 205, 206, 208 are fixed to the housing 117 to rotate with the housing 117.

The manifold assembly 108 has a first pipe 212 that is fluidly coupled to the pipe body 104 at the fluid inlet 109 and a second pipe 216 fluidly coupled to the pipe body 104 at a second fluid inlet 111 of the pipe body 104. The chamber 106 is disposed between the first fluid inlet 109 and the second fluid inlet 111. Each of the first and second pipes 212, 216 flow fluid into the pipe body 104 during a cementing operation. Each pipe has a respective valve 214, 218 that open and close independently from each other to launch each plug. The valves 214, 218 can be controlled by a controller that automatically and selectively opens and closes the valves 214, 218 during the cementing operation.

The slots 205, 206, 208 include at least a first slot 205 with a hollow cement plug 114 and a second slot 208 that houses a cement plug 116 that has a solid core. The pipe body 104 directs cement "C" or displacement fluid downhole to push and deploy the cementing plug that is aligned with the pipe body 104. For example, the pipe body 104 first receives cement slurry "C" at the inlet 109 and directs the cement "C" from the fluid inlet 109 down to the inlet of the wellbore to push, from the first slot 205, the first cementing plug 114. The pump continues to pump cement "C" to push and deploy the cementing plug downhole within the wellbore.

Once the first cementing plug 114 is deployed, the second slot 208 revolves about the central axis 'A' of the chamber 106 to align the second slot (and by extension the second cementing plug 116) with the bore 220 of the pipe body 104. Once aligned, the second cementing plug 116 is pushed downhole with displacement fluid (see FIG. 1) flowed from the inlet 109 downhole into the wellbore. The displacement fluid pushes the solid plug 116 to a downhole location of the wellbore, pushing the cement slurry disposed between the first plug 114 and second plug 116 downhole until the first plug 114 reached the bottom of the casing. The displacement fluid applies pressure to the first plug 114 until the cement ruptures a rupture disk of the plug 114 to allow the cement to flow out of the wellbore and into the annulus of the wellbore.

For example, the first cementing plug 114 has a hollow core and a rupture disk or diaphragm disposed at or above the hollow core 203 of the cementing plug 114. The pump flows the displacement fluid and by extension pressurizes the cement slurry downhole to a sufficient pressure to rupture, with the cementing plug 114 at a downhole end of the casing, the disk or diaphragm of the plug 114 to flow the cement through the hollow core 203 and out the casing into an annulus defined between the casing and the wall of the wellbore.

Figure 3:
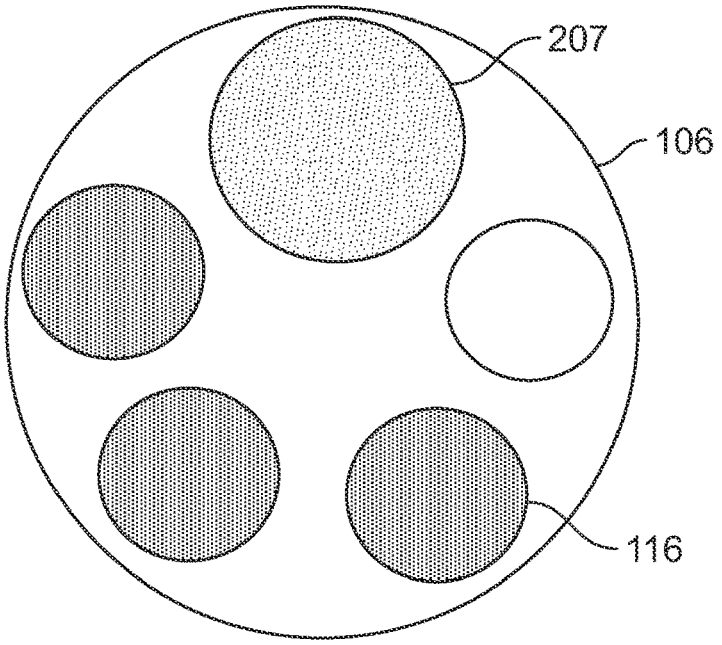
FIG. 3 is a schematic top view, cross-sectional, of a chamber of the cementing assembly.

The cementing assembly 101 also includes a drive 210 (e.g., an electric motor) coupled to the chamber 106 to rotate the slots. The drive revolves the slots about the central axis "A" of the chamber. Referring also to FIG. 3, the slots of the chamber 106 can be of different sizes or otherwise arranged to fit cementing plugs of different sizes. For example, one of the slots 207 can be sized to fit a cementing plug larger than another plug 116. The electric motor rotates the chamber 106 one or more slots at a time to position a selected slot at the bore of the pipe body 104.

The cementing assembly 101 also includes a controller 204 coupled (e.g., with cable 217) to the drive 210. The controller 204 can be disposed outside or inside of the pipe body 104 and can be attached to or spaced from the pipe body 104. The controller 204 controls the drive 210 based on information received from sensors (or user inputs) or other information to control the drive 210 and position a desired slot along the bore of the pipe body 104. For example, each slot can have a sensor 209 (e.g., a motion sensor) that send information to the controller 204 that indicates whether the plug slot is properly aligned with the bore of the pipe body 104 and ready to be deployed. The controller 204 can have or be coupled to an illumination source or another visual indicator (e.g., a green light) that is displayed when the slot is properly aligned. The controller 204 is communicatively coupled to each sensor. The controller 204 sends instructions to the drive 210 to rotate, based on the determination, the slots in clockwise or counterclockwise direction until the respective slot is aligned with the bore.

The cementing assembly 101 can also have one or more flow meter sensors 222, a timer 224, a battery 202 (e.g., a lithium ion battery pack), and a data storage device. Each of the flow meter sensors 222, timer 224, battery 202, and data storage device are communicatively coupled to the controller 204. The controller controls at least one of the pump and the drive 210 based on information received from at least one of the flow meter 222, the timer 224, or the data storage device. For example, the controller 204 control de pump or pumps and the drive 210 to perform m a cementing operation automatically from beginning to end.

The controller 204 can determine the location or depth of each cement retainer (or the size and type of cement retainer) based on the information received from flow meter, the timer, or the data storage device. In some implementation, the controller transmits, to a receiver (e.g., a receiver of a computing device with a user interface), the information about the location of each cementing plug or other related information. Additionally, the controller 204 can be wirelessly coupled to an input device 226 that transmits, to the controller 204, input instructions to control the wellbore assembly.

Figure 4:
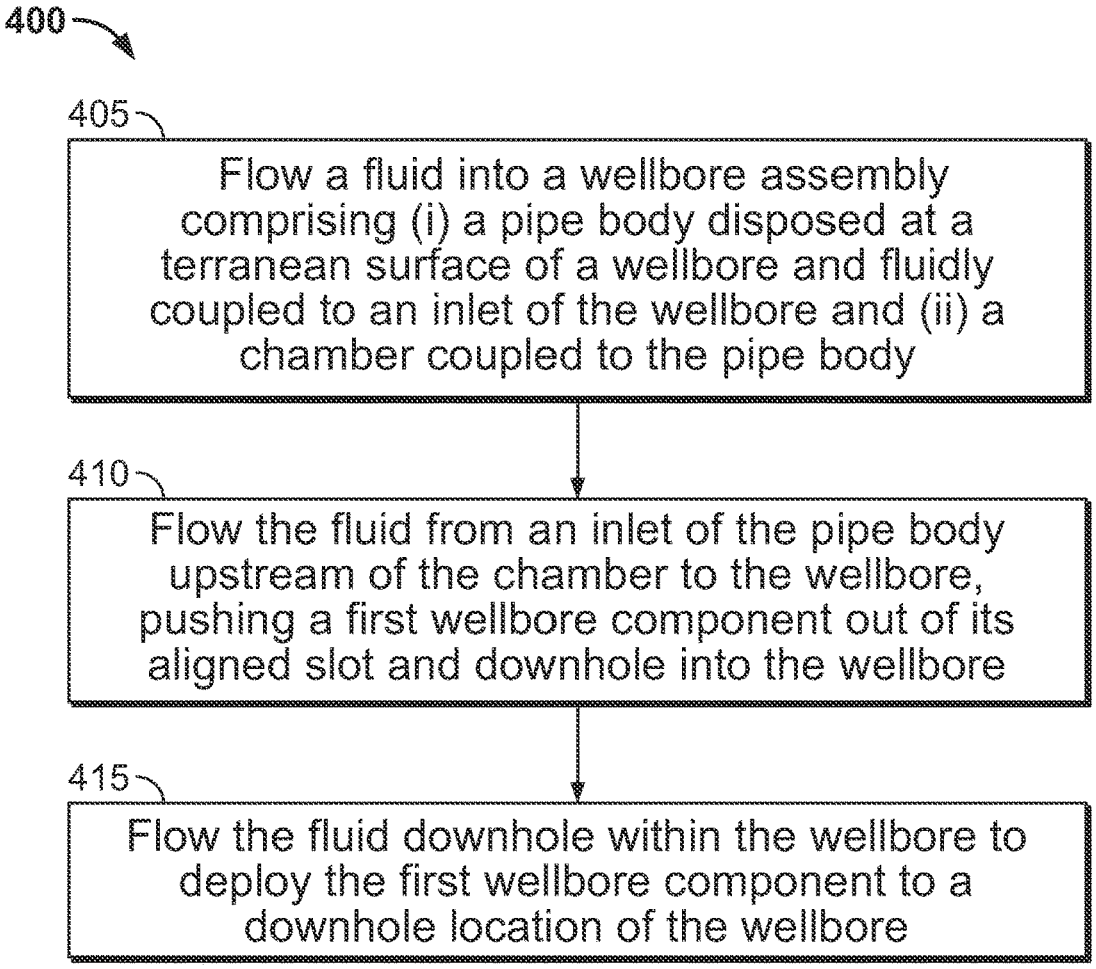
FIG. 4 is a flow chart of a method of cementing a wellbore.

FIG. 4 shows a flow chart of a method 400 of cementing a wellbore. The method includes flowing a fluid into a wellbore assembly, the wellbore assembly comprising (i) a pipe body disposed at a terranean surface of a wellbore and fluidly coupled to an inlet of the wellbore, and (ii) a chamber coupled to the pipe body. The chamber has multiple slots each configured to house a wellbore component. Each slot revolves about or around a central axis of the chamber and with respect to the pipe body to align one slot at a time with a bore of the pipe body (405). The method also includes flowing the fluid from an inlet of the pipe body upstream of the chamber to the wellbore, pushing a first wellbore component out of its aligned slot and downhole into the wellbore (410). The method also includes flowing the fluid downhole within the wellbore to deploy the first wellbore component to a downhole location of the wellbore (415).

Figure 5:
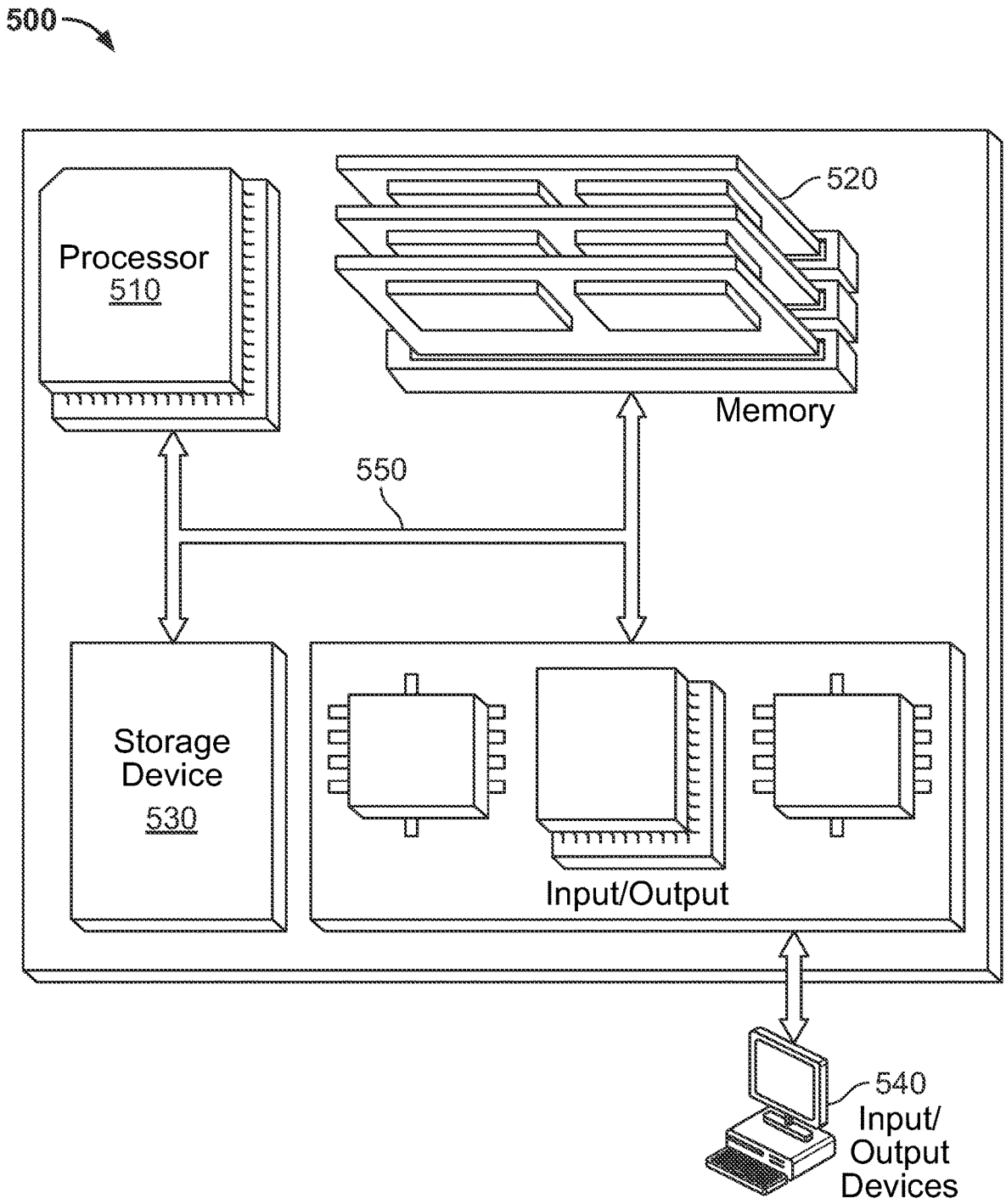
FIG. 5 is a schematic illustration of an example control system or controller according to implementations of the present disclosure.

FIG. 5 is a schematic illustration of an example control system or controller for a flow meter according to the present disclosure. For example, the controller 500 may include or be part of the controller 204 shown in FIG. 2. The controller 500 is intended to include various forms of digital computers, such as printed circuit boards (PCB), processors, digital circuitry, or otherwise. Additionally, the system can include portable storage media, such as, Universal Serial Bus (USB) flash drives. For example, the USB flash drives may store operating systems and other applications. The USB flash drives can include input/output components, such as a wireless transmitter or USB connector that may be inserted into a USB port of another computing device.

The controller 500 includes a processor 510, a memory 520, a storage device 530, and an input/output device 540. Each of the components 510, 520, 530, and 540 are interconnected using a system bus 550. The processor 510 is capable of processing instructions for execution within the controller 500. The processor may be designed using any of a number of architectures. For example, the processor 510 may be a CISC (Complex Instruction Set Computers) processor, a RISC (Reduced Instruction Set Computer) processor, or a MISC (Minimal Instruction Set Computer) processor.

In one implementation, the processor 510 is a single-threaded processor. In another implementation, the processor 510 is a multi-threaded processor. The processor 510 is capable of processing instructions stored in the memory 520 or on the storage device 530 to display graphical information for a user interface on the input/output device 540.

The memory 520 stores information within the controller 500. In one implementation, the memory 520 is a computer-readable medium. In one implementation, the memory 520 is a volatile memory unit. In another implementation, the memory 520 is a non-volatile memory unit.

The storage device 530 is capable of providing mass storage for the controller 500. In one implementation, the storage device 530 is a computer-readable medium. In various different implementations, the storage device 530 may be a floppy disk device, a hard disk device, an optical disk device, or a tape device.

The input/output device 540 provides input/output operations for the controller 500. In one implementation, the input/output device 540 includes a keyboard and/or pointing device. In another implementation, the input/output device 540 includes a display unit for displaying graphical user interfaces.

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that the mere use of the term "first" and "second" does not require that there be any "third" component, although that possibility is contemplated under the scope of the present disclosure.

What is claimed is:

1. A wellbore assembly, comprising:

a pipe body configured to reside at or near a terranean surface of a wellbore, the pipe body configured to be fluidly coupled to a surface inlet of the wellbore;

a chamber configured to be coupled to the pipe body, the chamber comprising a plurality of slots each configured to house a wellbore component, each slot configured to revolve about a central axis of the chamber to align its respective wellbore component with a bore of the pipe body;

a pump fluidly coupled to the pipe body and configured to flow fluid from a fluid inlet of the pipe body, through the chamber, and to the inlet of the wellbore to push and deploy, from a first slot, a first wellbore component downhole within the wellbore;

a drive coupled to and configured to revolve the plurality of slots about the central axis;

one or more sensors attached to the pipe body or the wellbore; and a controller electrically coupled to the one or more sensors and electrically coupled to and configured to control the drive and the pump, the controller configured to, as a function of feedback received from the one or more sensors:

control the pump to flow the first fluid and deploy the first wellbore component, control the drive to revolve the plurality of slots and align a second wellbore component with the bore of the pipe body; and control the pump to flow a second fluid and deploy the second wellbore component within the wellbore, performing a cementing operation in the wellbore.

2. The wellbore assembly of claim 1, wherein the pipe body is fluidly coupled to wellbore casing, the first wellbore component comprises a first cementing plug and the fluid comprises cement slurry, the chamber comprising a second slot housing a second cement plug comprising a solid core, the second slot configured to revolve, after deploying the first cementing plug, about the central axis of the chamber to align the second cement plug with the bore of the pipe body, and the pipe body is configured to direct displacement fluid downhole to push and deploy, with the displacement fluid, the second cementing plug to a downhole location of the casing.

3. The wellbore assembly of claim 2, wherein the first cementing plug comprises a hollow core and a rupture disk or diaphragm disposed at the hollow core, the pump configured to pressurize the cement slurry sufficiently to rupture, with the first cementing plug at a downhole end of the casing, the disk or diaphragm to flow the cement through the hollow core and out the casing into an annulus defined between the casing and the wellbore.

4. The wellbore assembly of claim 3, wherein the pipe body is configured to direct the displacement fluid downhole to push the second cementing plug at sufficient pressure to rupture the disk or diaphragm and continue to push the second cementing plug to land at the first cementing plug.

5. The wellbore assembly of claim 1, wherein the drive is secured to an external surface of the chamber and configured to revolve the plurality of slots, the plurality of slots comprising slots of different sizes.

6. The wellbore assembly of claim 5, wherein the controller is coupled to the drive, each slot comprising one of the one or more sensors, the controller communicatively coupled to each sensor and configured to determine, based on information received from a respective sensor, whether a respective slot at the bore is properly aligned with the bore, the controller configured to send instructions to the drive to rotate, based on the determination, the slots to align the respective slot with the bore.

7. The wellbore assembly of claim 6, further comprising at least one of a flow meter sensor communicatively coupled to the controller, a timer communicatively coupled to the controller, a battery communicatively coupled to the controller, or a data storage device communicatively coupled to the controller, the controller configured to control at least one of the pump or the drive based on information received from at least one of the flow meter, the timer, or the data storage device.

8. The wellbore assembly of claim 7, wherein the controller is configured to determine, based on information received from at least one of the flow meter, the timer, or the data storage device, component information comprising (i) at least one of a depth of each deployed wellbore component or a location of each deployed wellbore component within the wellbore, and (ii) at least one of a size of each wellbore component or a type of each wellbore component, the controller configured to transmit, to a receiver, the component information.

9. The wellbore assembly of claim 6, wherein the controller is configured to be wirelessly coupled to an input device configured to transmit, to the controller, input instructions to control the wellbore assembly.

10. The wellbore assembly of claim 1, further comprising a manifold assembly configured to be coupled to the pipe body, the manifold assembly comprising a first pipe configured to be fluidly coupled to the pipe body at the fluid inlet and a second pipe configured to be fluidly coupled to the pipe body at a second fluid inlet of the pipe body, the chamber disposed between the fluid inlet and the second fluid inlet, and each of the first and second pipes configured to flow fluid into the pipe body during a cementing operation.

11. The wellbore assembly of claim 1, wherein the first fluid comprises a cement slurry and the second fluid comprises a displacement fluid.

12. The wellbore assembly of claim 1, wherein the one or more sensors comprise a flow meter coupled to the pipe body and a timer coupled to the pipe body.

13. The wellbore assembly of claim 12, wherein the controller is configured to control, as a function of feedback received from the flow meter and the timer, the pump and drive to automatically perform a complete cementing operation.

14. The wellbore assembly of claim 1, wherein the drive comprises a motor coupled to a central shaft that rotates the chamber.

15. The wellbore assembly of claim 1, wherein the controller is coupled to and configured to control a valve at the fluid inlet of the pipe body to regulate a flow of fluid into the pipe body.

16. A method, comprising:

flowing a first fluid into a wellbore assembly, the wellbore assembly comprising (i) a pipe body disposed at a terranean surface of a wellbore and fluidly coupled to an inlet of the wellbore, (ii) a chamber coupled to the pipe body, (iii) a pump fluidly coupled to the pipe body, (iv) a drive coupled to the chamber, (v) one or more sensors attached to the pipe body or the wellbore, (vi) and a controller configured to control the pump and the drive as a function of feedback received from the one or more sensors, the chamber comprising a plurality of slots each configured to house a respective wellbore component, each slot movable by the drive to revolve about a central axis of the chamber and with respect to the pipe body to align one slot at a time with a bore of the pipe body, the flowing comprising controlling, by the controller, the pump to flow the first fluid;

flowing the fluid from an inlet of the pipe body upstream of the chamber to the wellbore, pushing a first wellbore component out of its aligned slot and downhole into the wellbore, the flowing comprising controlling, by the controller, the pump to flow the first fluid;

aligning, by controlling the drive with the controller to revolve the slots, a second wellbore component with the bore of the pipe body; and flowing, by controlling the pump with the controller, a second fluid with the pump to deploy the second wellbore component to perform a cementing operation in the wellbore.

17. The method of claim 16, wherein the pipe body is fluidly coupled to a wellbore casing, the first wellbore component comprises a first cementing plug and the fluid comprises cement slurry, the chamber comprising a second slot housing a second cement plug comprising a solid core, the second slot configured to revolve, after deploying the first cementing plug, about the central axis of the chamber to align the second cement plug with the bore of the pipe body, and the method further comprises flowing a displacement fluid downhole from the pipe body, deploying the second cementing plug to a downhole location of the casing and pushing the cement slurry downhole with the second cement plug.

18. The method of claim 17, wherein the first cementing plug comprises a hollow core and a rupture disk or diaphragm, and wherein flowing the cement slurry comprises flowing the cement slurry at a pressure sufficient to rupture, with the first cementing plug at a downhole end of the casing, the disk or diaphragm to flow the cement through the hollow core and out the casing into an annulus defined between the casing and the wellbore.

19. The method of claim 16, wherein the wellbore assembly comprises a drive coupled to the plurality of slots, the drive coupled to a controller, the controller configured control the drive to revolve the slots about the central axis of the chamber until a respective slot is aligned with the bore of the pipe body, and flowing the fluid to push the first wellbore component comprises flowing the fluid after the respective wellbore component is aligned with the bore of the pipe body.

20. The method of claim 19, further comprising at least one of a flow meter sensor communicatively coupled to the controller, a timer communicatively coupled to the controller, a battery communicatively coupled to the controller, or a data storage device communicatively coupled to the controller, the controller configured to control the pump and wherein flowing the fluid to push the first wellbore component comprises activating, by the controller, the pump to flow the fluid based on information received by the controller from at least one of the flow meter, the timer, or the data storage device.

* * * * *